United States Patent [19]

Brooks

[11] 4,374,058

[45] Feb. 15, 1983

[54] METHOD FOR PRODUCING POWDERED DETERGENT CONTAINING ALPHA OLEFIN SULFONATE

[75] Inventor: Burton Brooks, Bellevue, Wash.

[73] Assignee: The Chemithon Corporation, Seattle, Wash.

[21] Appl. No.: 315,160

[22] Filed: Oct. 26, 1981

[51] Int. Cl.[3] ..... C11D 11/00; C11D 11/02; C11D 1/37

[52] U.S. Cl. ..... 252/556; 252/536; 252/537; 252/555; 252/539; 252/558; 264/117

[58] Field of Search ..... 23/313 R, 313 FB, 313 P; 264/117; 252/536, 537, 555, 556, 558, 539; 366/173

[56] References Cited

U.S. PATENT DOCUMENTS

| | | | |
|---|---|---|---|
| 3,502,304 | 11/1966 | Pfrengle | 264/109 |
| 3,625,902 | 12/1971 | Sumner | 252/99 |
| 3,741,904 | 6/1973 | Christensen et al. | 252/99 |
| 3,838,072 | 9/1974 | Smith et al. | 252/540 |
| 3,888,781 | 6/1975 | Kingry et al. | 252/99 |
| 3,950,275 | 4/1976 | Toyoda et al. | 252/527 |

FOREIGN PATENT DOCUMENTS 1618228 8/1977 Fed. Rep. of Germany .

*Primary Examiner*—P. E. Willis, Jr.
*Attorney, Agent, or Firm*—Merriam, Marshall & Bicknell

[57] ABSTRACT

A first slurry containing alkyl benzene sulfonate is spray-dried to form dry, powdery particles which are introduced into a rotary drum mixer along with dry, powdery particles of other detergent ingredients. The dry, powdery particles are lifted and dropped in the mixer to form a descending curtain into which is sprayed a second slurry containing alpha olefin sulfonate, thereby agglomerating the ingredients into composite particles, each of which contains all the ingredients introduced into the mixer.

9 Claims, 2 Drawing Figures

METHOD FOR PRODUCING POWDERED DETERGENT CONTAINING ALPHA OLEFIN SULFONATE

BACKGROUND OF THE INVENTION

The present invention relates generally to methods for producing detergents and more particularly to a method for producing a powdered detergent containing alpha olefin sulfonate.

Powdered detergents are used primarily for laundering purposes. A typical powdered laundry detergent contains surface-active agents, among other ingredients. Two typical surface-active agents are alkyl benzene sulfonate and alpha olefin sulfonate. In many cases it is desirable to incorporate both of these sulfonates into a detergent. Alpha olefin sulfonate is a less expensive detergent ingredient than alkyl benzene sulfonate. Therefore, it is desirable to incorporate into a powdered laundry detergent as much alpha olefin sulfonate as is practicable, while retaining alkyl benzene sulfonate also as an ingredient.

Alkyl benzene sulfonates and alpha olefin sulfonate are usually produced in substantially liquid form by neutralizing the corresponding sulfonic acid of each with a base, such as sodium hydroxide, to form sodium alkyl benzene sulfonate or sodium alpha olefin sulfonate. These substantially liquid sulfonates must then be dried before they can be incorporated into a powdered detergent. Conventionally, the liquid sulfonates are mixed with other ingredients which are to be incorporated into the powdered detergent, and these include both organic and inorganic ingredients. Many of these other ingredients are in solid powder form before being mixed with the liquid sulfonates, and the resulting mixture may be a slurry which is then subjected to a spray-drying operation, for example. In such a case, the slurry of detergent ingredients must contain sufficient liquid to permit pumping and spraying.

Conventionally, the spray-drying operation is conducted in a spray-drying tower within which the slurry is sprayed from the top and descends to the bottom. During the descent, the slurry is dried by hot gases rising from the bottom to the top of the tower. The dried detergent is withdrawn from the bottom in the form of a powder containing beads each of which includes essentially all of the ingredients of the detergent.

A drawback to mixing dry, powdery ingredients into a slurry, containing sufficient liquid to render the slurry pumpable and sprayable, is that ingredients which were once dry are heavily wetted and then have to be dried again, which is a waste of energy. However, it is necessary to heavily wet and then dry these normally powdery ingredients, in a process in which all of the liquid sulfonate is spray-dried, in order to incorporate all of the detergent ingredients into each of the individual beads of detergent in the final dry, powdered detergent product.

Exhaust gases removed from the top of the spray-drying tower are treated to separate carry-over powder particles therefrom and are then vented to the atmosphere. A problem arises when spray-drying a slurry containing alpha olefin sulfonate in that the gases vented from the top of the spray-drying tower contain offensive gaseous ingredients which pollute the air when vented into the atmosphere.

In another method for producing a powdered detergent, dry, powdered, inorganic ingredients of the detergent are introduced into the upstream end of a rotary drum mixer, and the dry, powdered material is advanced from the upstream to the downstream end, while being lifted and dropped as the rotary drum mixer rotates. As the dry, powdery material undergoes lifting and dropping, it is sprayed with liquid sulfonic acid and neutralizing agent, either through separate nozzles or through a mixing nozzle. The liquid sulfonate formed during the spraying, or during the mixing immediately preceding the spraying, is absorbed by the particles of powdered detergent ingredients already in the drum mixer and agglomerates them into composite particles, each containing essentially all of the ingredients introduced into the mixer.

A method of the type described in the preceding paragraph is disclosed in Pfrengle, U.S. Pat. No. 3,502,304. In such a method the sulfonate must contain sufficient liquid to facilitate spraying through nozzles. Because there is a limit on the amount of liquid sulfonate which can be sprayed onto the dry particles before the latter become too soggy, the sulfonate content of a powdered detergent product produced by such a procedure without subsequent drying is limited to a relatively low amount.

SUMMARY OF THE INVENTION

The above-described drawbacks in the prior art methods of producing dry detergent products are eliminated by a method in accordance with the present invention.

Initially there is provided a first slurry containing neutralized alkyl benzene sulfonate but without alpha olefin sulfonate and without all or at least a substantial part of the two principal inorganic constituents of the dry, powdery detergent, namely, sodium sulfate and sodium tripolyphosphate. The latter two ingredients are normally available in dry, powdery form, and, as noted above, it is a waste of energy to heavily wet them, by incorporating them into a slurry, and then dry them again.

The slurry containing the alkyl benzene sulfonate is spray-dried in a spray-drying tower in the conventional manner to produce dry, powdery particles containing alkyl benzene sulfonate. Because the slurry undergoing spray-drying does not include alpha olefin sulfonate, there is no pollution problem when venting exhaust gases to the atmosphere.

The spray-dried particles containing alkyl benzene sulfonate constitute one category of dry powdery particles and are introduced into the upstream end of a mixing zone defined by a rotary drum mixer. Simultaneously introduced into the upstream end of the rotary drum mixer is another category of dry, powdery particles comprising detergent ingredients which are normally obtainable in dry, powdery form, such as sodium sulfate and sodium tripolyphosphate. These latter ingredients are each introduced in an amount equal to all or a substantial part of the amount to be included in the dry, powdered detergent end product.

The rotary drum mixer is rotated to advance both categories of dry, powdery particles toward the downstream end of the mixer. As they advance in the rotating mixer, the dry, powdery particles are lifted and dropped and undergo mixing.

Neutralized alpha olefin sulfonate is provided as a slurry containing sufficient water (e.g., at least about 60 wt.%) to permit the slurry to be sprayed through nozzles. This slurry of alpha olefin sulfonate (or second slurry) is conducted to the upstream end of the rotary drum mixer and sprayed through nozzles onto the dry, powdery particles already in the rotary drum mixer, as these particles undergo lifting and dropping. As a result, there are formed composite or agglomerated particles of relatively uniform size and composition comprising alkyl benzene sulfonate, alpha olefin sulfonate, the other ingredients introduced into the rotary drum mixer in dry powdery form, and whatever other ingredients were present in the dry, powdery particles containing alkyl benzene sulfonate after the latter had undergone spray-drying.

The liquid water in the second slurry, upon being sprayed into the rotary drum mixer, is absorbed into the composite particles, to dry the second slurry and produce the agglomeration. The composite particles are then removed as a relatively dry powder from the downstream end of the rotary drum mixer.

The composite particles contain ingredients, such as the sodium tripolyphosphate, which undergo hydration or chemical bonding with the water in the second slurry over a relatively short aging period (e.g., 6–8 hours). In accordance with the present invention, the amount of water in the second slurry and the rate at which the second slurry is sprayed onto the dry, powdery particles, are controlled so that the composite particles have a water content not substantially greater than that which can be chemically bound in the composite particles (e.g., about 15 wt.% max.).

Because the alpha olefin sulfonate slurry is not subjected to drying with hot gases, there are no offensive gases to be vented to the atmosphere, as is the case when alpha olefin sulfonate slurry is spray-dried with heated gases.

The dry, powdered detergent produced by a method in accordance with the present invention has a relatively low density comparable to that of a powdered detergent produced totally by spray-drying (e.g., in the range of about 0.3–0.5 g/ml).

A relatively low density is desirable for a powdered detergent product because, the lower the density, the larger the box required to contain a given weight of the detergent. Housewives and other retail purchasers of laundry detergents prefer to have their detergents in a big, full box, and the bigger the box for a given weight of detergent, the more desirable it is considered by the purchaser.

Other features and advantages are inherent in the method claimed and disclosed or will become apparent to those skilled in the art from the following detailed description in conjunction with the accompanying diagrammatic drawing.

DETAILED DESCRIPTION

Figure 1:
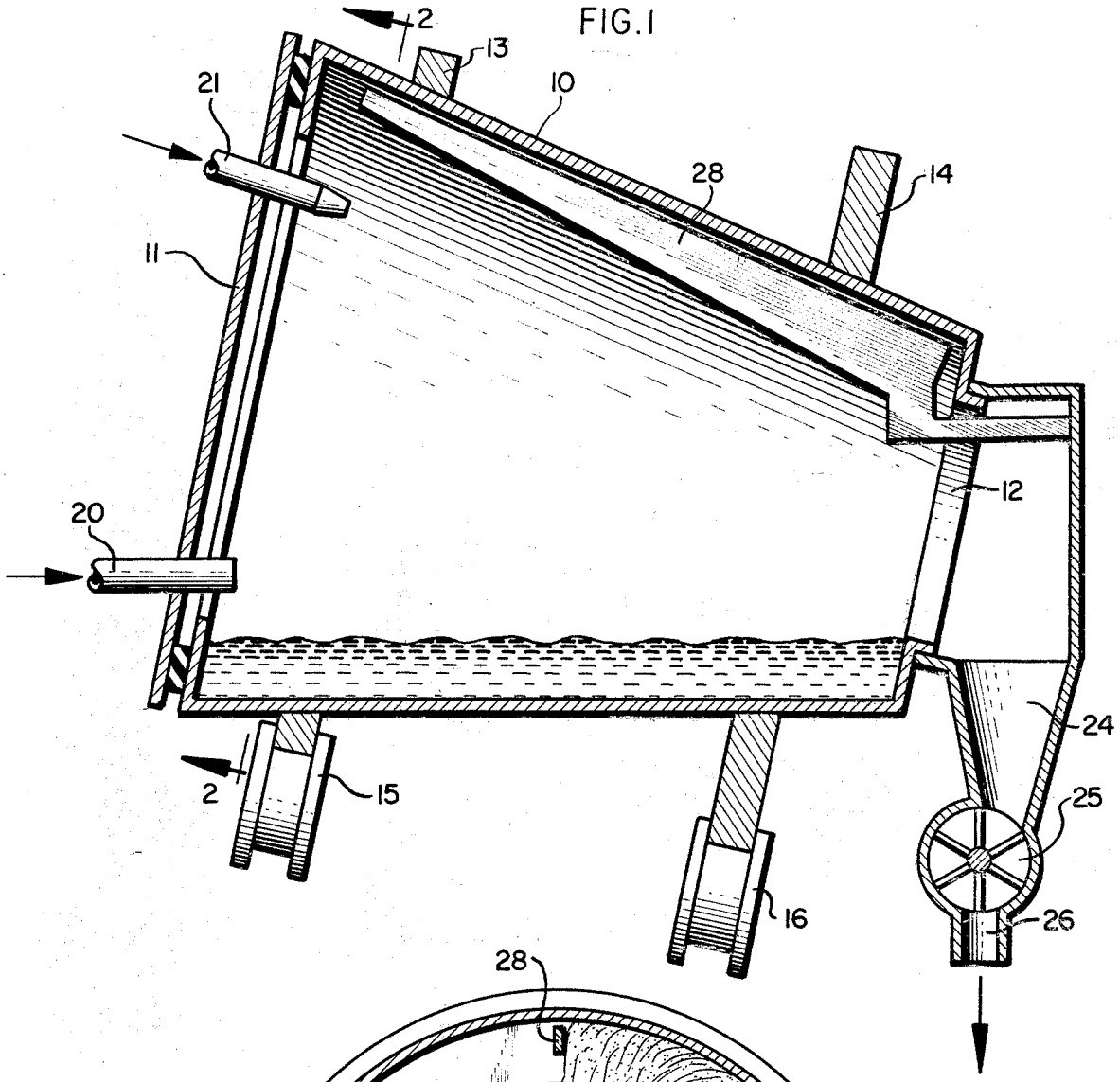
FIG. 1 is a longitudinal sectional view of an apparatus in which is conducted a method in accordance with an embodiment of the present invention.
Figure 2:
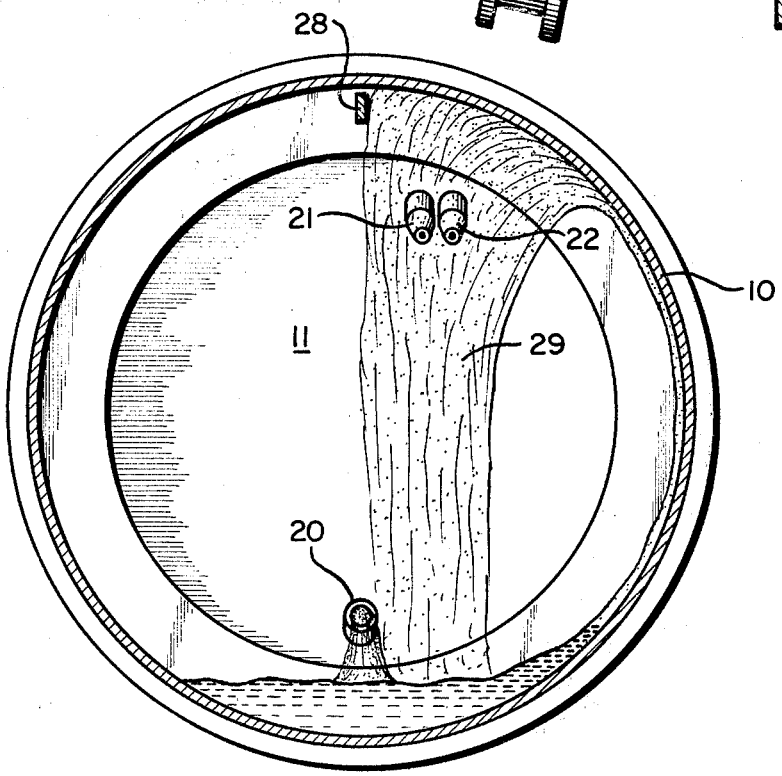
FIG. 2 is a sectional view taken along line 2—2 in FIG. 1.

Referring to the drawings, the rotary drum mixer comprises a shell 10 having a frusto-conical shape, an upstream end 11 and a downstream end 12. Located around the periphery of shell 10 are a pair of circumferential rings 13, 14 engaged by respective rollers 15, 16.

Located at upstream end 11, near the bottom thereof, is a supply conduit 20, and located at upstream end 11, near the top thereof, are a pair of spray nozzles 21, 22. Located adjacent downstream end 12 is an exit chute 24 communicating with a rotary control valve 25 in turn communicating with an outlet conduit 26. Disposed within shell 10, near the top thereof, is a scraper member 28.

The structure and operation of the rotary drum mixer described above are disclosed in greater detail in Pfrengle, U.S. Pat. No. 3,502,304, and the disclosure therein is incorporated herein by reference.

In a method in accordance with the present invention, a first category of dry, powdery particles containing alkyl benzene sulfonate, but not containing alpha olefin sulfonate, are introduced into the rotary drum mixer through supply conduit 20. The first category of dry, powdery particles was produced by spray drying a first slurry containing neutralized alkyl benzene sulfonate in a heated, spray-drying tower, in a conventional manner. The first slurry may also contain other ingredients conventionally incorporated into a detergent except that the first slurry need not contain ingredients which are normally available in dry, powdery form, such as sodium sulfate and sodium tripolyphosphate. Such ingredients, which constitute a second category of dry, powdered particles, are introduced totally, or at least in substantial part, into the rotary drum mixer through supply conduit 20 simultaneously with the first category of dry powdery particles.

The rotary drum mixer is rotated to advance both categories of dry, powdery particles toward the downstream end of the mixer. As the mixer is rotated, the particles are lifted and dropped, and the two categories of particles undergo mixing as they advance in the rotating mixer. The rotary drum mixer is rotated at a sufficient rate to carry the dry, powdered particles up along the inside of shell 10 towards the top of the shell. As the particles, thus carried, approach the top of shell 10, some of them begin to drop towards the bottom of the shell. Those particles which are carried all the way around to the extreme top of the shell encounter scraper member 28 which prevents the particles from advancing further along the inside of the shell and causes them to drop toward the bottom of the shell. The dropping particles form a curtain 29 which extends from the upstream end 11 to the downstream end 12 of the mixer.

A second slurry comprising neutralized alpha olefin sulfonate and containing liquid water is conducted to nozzles 21, 22 at the upstream end 11 of the rotary drum mixer, and the second slurry is sprayed into curtain 29 through nozzles 21, 22.

As a result of the lifting and dropping of the dry powdery particles as they undergo advancement in the rotating mixer and of the spraying of the second slurry into the curtain of dropping particles, there are formed composite particles of relatively uniform size and composition comprising alkyl benzene sulfonate, alpha olefin sulfonate, and whatever other ingredients were contained in the dry, powdery particles introduced into the mixer through supply conduit 20, including sodium sulfate and sodium tripolyphosphate. All of these ingredients are agglomerated into the composite particles.

The liquid water in the second slurry is absorbed into the composite particles to dry the second slurry.

The composite particles are removed from the mixer as a relatively dry powder through exit chute 24, control valve 25 and outlet conduit 26.

The alpha olefin sulfonate is introduced into the mixer as a neutralized slurry, and the alkyl benzene sulfonate is introduced into the mixer as a neutralized dry powder, thereby substantially avoiding any heat-generating reactions within the rotary drum mixer. The temperature of the mixer is maintained substantially no greater than ambient temperature.

The alpha olefin sulfonate comprises about 6–15 wt.% of the total material in the composite particles. The amount of water in the second slurry is at least about 60 wt.% to permit spraying of the slurry through nozzles 21, 22. The rate at which the second slurry is sprayed onto the dry, powdered particles in the mixing zone is controlled to provide a water content in the composite particles not substantially greater than that which can be chemically bound with other ingredients in the composite particles, such as sodium tripolyphosphate. The chemical bonding occurs over a short aging period (e.g., 6–8 hours) following formation of the composite particles.

Generally, the combined amount of alkyl benzene sulfonate and alpha olefin sulfonate in the powdered detergent is greater than about 20 wt.% and up to about 40 wt.% of the powdered detergent. The composite particles have a density in the range of about 0.3–0.5 g/ml.

Because the alkyl benzene sulfonate was spray-dried before introduction into the rotary drum mixer, the alkyl benzene sulfonate contributes relatively little water to the composite particles formed in the mixer, compared to a method in which the alkyl benzene sulfonate is sprayed into the mixer. This means that the composite particle can tolerate, as a proportion of the total water in the composite particle, relatively more water from the alpha olefin sulfonate slurry. This in turn means that more alpha olefin sulfonate slurry can be introduced into the mixer, thus increasing the relative alpha olefin content of the composite particle without necessarily decreasing the absolute amount of alkyl benzene sulfonate therein.

Examples of a powdered detergent produced by a method in accordance with the present invention are tabulated below as A and B. In the method employed to produce these two examples, the spray-dried product made from the first slurry contained not only alkyl benzene sulfonate but also all or some of each of the other ingredients in Examples A and B except sodium alpha olefin sulfonate. Part of the sodium sulfate and sodium tripolyphosphate in Examples A and B were contained in the first slurry (and the spray-dried product made therefrom), as was part of the water. The first slurry was 61–63 wt.% solids. The dry, powdery particles introduced into the rotary drum mixer consisted of about two-thirds spray-dried product containing alkyl benzene sulfonate, about one-sixth dry, powdered sodium sulfate and about one-sixth dry powdered sodium tripolyphosphate. The composition of the spray-dried product is listed in the following tabulation, for comparison purposes. All percentages are in weight percent.

| Ingredient | (A) | (B) | Spray Dried Product |
|---|---|---|---|
| Sodium alkyl benzene sulfonate | 16.97% | 16.30% | 28.0% |
| Sodium toluene sulfonate | 1.70 | 1.63 | 2.8 |
| Sodium silicate | 5.09 | 4.89 | 8.4 |
| Coconut monoethanolamine | 1.52 | 1.46 | 2.5 |
| Carboxymethyl cellulose | 1.52 | 1.46 | 2.5 |
| Ethylene diamine tetramine | 0.24 | 0.23 | 0.4 |
| Optical brightener | 0.12 | 0.12 | 0.2 |
| Sodium Sulfate | 23.15 | 22.24 | 13.02 |
| Sodium tripolyphosphate | 35.15 | 33.77 | 33.0 |
| Water | 5.45 | 5.24 | 9.0 |
| Sodium alpha olefin sulfonate | 9.10 | 12.66 | 0.0 |
| | 100.01 | 100.00 | 100.0 |

Tabulated below are the specific gravities of the aforementioned Examples A and B. For comparison purposes, also included in the tabulation are the specific gravities of the spray-dried product, sodium sulfate and sodium tripolyphosphate. On a calculated basis, the specific gravity of the combined powders employed in producing Examples A and B would be about 0.53 g/ml, but, as produced by the method of the present invention, the specific gravity is substantially smaller, between 0.3 and 0.4 g/ml., which is desirable.

| SPECIFIC GRAVITY | |
|---|---|
| 9.10% AOS (A) | 0.351 g/ml |
| 12.66% AOS (B) | 0.333 g/ml |
| Spray-dried product | 0.32 g/ml |
| Sodium sulphate | 1.035 g/ml |
| Sodium tripolyphosphate | 0.880 g/ml |

Set forth below is a tabulation containing the particle size distribution for Examples A and B as well as the particle size distribution for the spray-dried product and for sodium sulfate and sodium tripolyphosphate.

| | 18 | 20 | 40 | 50 | 80 | 100 | 140 | 200 | Total |
|---|---|---|---|---|---|---|---|---|---|
| 9.1% AOS (A) | 9.46* | 10.10 | 52.69 | 14.58 | 7.54 | 1.15 | 4.22 | 0.26 | 100.00 |
| | (7.4)** | (7.9) | (41.2) | (11.4) | (5.9) | (0.9) | (3.3) | (0.2) | (78.2) |
| 12.66% AOS (B) | 28.70 | 13.44 | 46.26 | 7.33 | 3.21 | 0.46 | 0.31 | 0.31 | 100.00 |
| | (18.8) | (8.8) | (30.3) | (4.8) | (2.1) | (0.3) | (0.2) | (0.2) | (65.5) |
| Spray dried product | 1.93 | 1.93 | 49.7 | 27.89 | 14.99 | 2.52 | 0.74 | 0.30 | 100.00 |
| | (1.3) | (1.3) | (33.5) | (18.8) | (10.1) | (1.7) | (0.5) | (0.2) | (67.4) |
| Sodium sulfate | 0.83 | 0.58 | 12.92 | 14.00 | 19.97 | 11.85 | 23.12 | 16.74 | 100.00 |
| | (1.0) | (0.7) | (15.6) | (16.9) | (24.1) | (14.3) | (27.9) | (20.2) | (120.7) |
| Sodium tripoly- | 0.43 | 0.18 | 4.95 | 41.69 | 18.95 | 15.28 | 12.59 | 5.93 | 100.00 |
| | (0.7) | (0.3) | (8.1) | (68.2) | (31.0) | (25.0) | (20.6) | (9.7) | (163.6) |

*% OF SAMPLE BY WEIGHT HELD ON SCREEN
**WEIGHT IN GRAMS

Examples A and B were produced by an embodiment of the present invention in which some of the sodium sulfate and sodium tripolyphosphate were in the first slurry. In another embodiment of the present invention, the dry powdery particles obtained by spray drying the first slurry do not contain any sodium sulfate or sodium tripolyphosphate, but they do contain, in addition to alkyl benzene sulfonate, virtually every other ingredient in the finished powdered detergent except the alpha olefin sulfonate, the sodium sulfate, the sodium tripolyphosphate, and a major part of the water. In this embodiment, all of the sodium sulfate and sodium tripolyphosphate are introduced into the rotary drum mixer in their original dry, powdery form without having been incorporated into the first slurry. The sodium alpha olefin sulfonate and a major part of the water in the end product are introduced by spraying the second slurry into the rotary drum mixer in the manner described above.

The foregoing detailed description has been given for clearness of understanding only, and no unnecessary limitations should be understood therefrom, as modifications will be obvious to those skilled in the art.

I claim:

1. A method for producing a powdered detergent containing an alkyl benzene sulfonate and an alpha olefin sulfonate, said method comprising the steps of:

providing a first slurry containing neutralized alkyl benzene sulfonate without alpha olefin sulfonate;

spray-drying said first slurry in a heated spray drying tower to produce dry, powdery particles containing alkyl benzene sulfonate;

introducing said dry, powdery particles containing alkyl benzene sulfonate into the upstream end of a mixing zone;

advancing said dry, powdery particles containing alkyl benzene sulfonate toward said downstream end of the mixing zone;

lifting and dropping said particles containing alkyl benzene sulfonate as they undergo advancement in said mixing zone;

providing, at the upstream end of the mixing zone, a second slurry of neutralized alpha olefin sulfonate containing liquid water;

spraying said second slurry onto said dry powdery particles containing alkyl benzene sulfonate, as said particles undergo said lifting and dropping, to form composite particles of relatively uniform size and composition comprising said alkyl benzene sulfontate and said alpha olefin sulfonate;

the liquid water in said second slurry being absorbed into said composite particles to dry said second slurry;

and removing said composite particles as a relatively dry powder from the downstream end of said mixing zone.

2. A method as recited in claim 1 wherein said composite particles removed from said mixing zone have a density in the range of about 0.3–0.5 g/ml.

3. A method as recited in claim 1 and comprising:

substantially avoiding heat generating reactions in said mixing zone;

and maintaining the temperature in said mixing zone substantially no greater than ambient temperature.

4. A method as recited in claim 1 and comprising:

adding other detergent constituents to said mixing zone as dry powdery particles;

mixing said dry powdery particles of said other detergent constituents with said dry powdery particles containing alkyl benzene sulfonate during said advancing step;

said dry powdery particles of the other detergent constituents undergoing said advancement and said lifting and dropping along with the particles containing alkyl benzene sulfonate during said advancing step;

and agglomerating the dry, powdery particles of said other detergent constituents with the dry, powdery particles of said alkyl benzene sulfonate, into said composite particles, during said spraying step.

5. A method as recited in claim 4 wherein:

said alpha olefin sulfonate comprises 6–15 wt.% of the material in said composite particles;

at least one of said other detergent constituents is chemically bondable with water;

said method comprising controlling the amount of water in said second slurry, and the rate at which said second slurry is sprayed into said dry, powdery particles, to make said second slurry thin enough to be sprayed while providing a water content in the composite particles not substantially greater than that which can be chemically bound in said composite particles;

and aging said composite particles for at least six hours to chemically bond at least the major part of the water in said composite particles.

6. A method as recited in claim 5 wherein:

the amount of water in said second slurry is at least about 60 wt.% to permit said spraying;

and the total water content in said composite particles is no greater than about 15 wt.%.

7. A method as recited in claim 4 wherein:

said first slurry does not contain any of said other detergent constituents added to said mixing zone as dry, powdery particles.

8. A method as recited in claim 1 wherein:

the combined amount of said alkyl benzene sulfonate and said alpha olefin sulfonate in said powdered detergent is greater than about 20 wt.%.

9. A method as recited in claim 1 wherein:

said combined amount constitutes up to about 40 wt.% of said powdered detergent.

* * * * *